US007072607B2

(12) United States Patent
Haraguchi et al.

(10) Patent No.: US 7,072,607 B2
(45) Date of Patent: Jul. 4, 2006

(54) DEVELOPING APPARATUS

(75) Inventors: Manami Haraguchi, Yokohama (JP); Takeshi Yamamoto, Yokohama (JP); Makoto Fukatsu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 10/733,358

(22) Filed: Dec. 12, 2003

(65) Prior Publication Data

US 2004/0165914 A1 Aug. 26, 2004

(30) Foreign Application Priority Data

Dec. 13, 2002 (JP) ..... 2002-362070

(51) Int. Cl.
*G03G 15/08* (2006.01)

(52) U.S. Cl. ..... 399/281; 399/283

(58) Field of Classification Search ..... 399/281, 399/283, 279, 286, 272, 273; 430/120
See application file for complete search history.

(56) References Cited

U.S. PATENT DOCUMENTS

| | | | | |
|---|---|---|---|---|
| 4,893,151 | A * | 1/1990 | Yamazaki et al. | 399/286 X |
| 5,324,884 | A * | 6/1994 | Honda et al. | 399/279 |
| 6,151,473 | A * | 11/2000 | Saito et al. | 399/281 |
| 6,229,980 | B1 | 5/2001 | Ogawa et al. | 399/283 |
| 6,345,166 | B1 * | 2/2002 | Sakaizawa et al. | 399/283 |
| 6,560,430 | B1 | 5/2003 | Muto et al. | 399/255 |
| 6,738,593 | B1 * | 5/2004 | Kawamura et al. | 399/281 |
| 6,868,247 | B1 * | 3/2005 | Sato et al. | 399/281 |
| 2003/0210931 | A1 | 11/2003 | Haraguchi et al. | 399/281 |

FOREIGN PATENT DOCUMENTS

| | | |
|---|---|---|
| JP | 5-257376 | 10/1993 |
| JP | 6-289705 | 10/1994 |
| JP | 2002-108089 | 4/2002 |

* cited by examiner

*Primary Examiner*—Sophia S. Chen
(74) *Attorney, Agent, or Firm*—Fitzpatrick, Cella, Harper & Scinto

(57) ABSTRACT

A developing apparatus includes a developer carrying member for carrying a developer to develop an electrostatic latent image formed on and image bearing member, the developer carrying member having an elastic property; scraping/supplying member, contacted into the developer carrying member, for supplying the developer to the developer carrying member and for scraping the developer off the developer carrying member, the scraping/supplying member having an elastic property, wherein the developer carrying member has a hardness which is higher than that of the scraping/supplying member, and wherein the developer carrying member and the scraping/supplying member satisfy that in a state in which the scraping/supplying member is out of contact with the developer carrying member, a radius of curvature of the scraping/supplying member is larger than a radius of curvature of the developer carrying member at a position of contact between the scraping/supplying member and the developer carrying member.

23 Claims, 11 Drawing Sheets

(a)

(b)

DEVELOPING APPARATUS

FIELD OF THE INVENTION AND RELATED ART

The present invention relates to a developing apparatus which employs developer to develop a static image formed on an image bearing member such as a photosensitive member or a dielectric member. In particular, it relates to a developing apparatus which employs dry developer, and is suitable for an image forming apparatus such as a copying machine, a printer, etc., which employs an electrophotographic or electrostatic recording method.

It has been a common practice to use developer (toner) in the powder form in order to visualize an electrostatic latent image formed on the image bearing member, such as an electrophotographic photosensitive member or an electrostatically recordable dielectric member, of an image forming apparatus such as a copying machine or a printer.

First, referring to FIG. 1, an example of an image forming apparatus, in accordance with the prior arts, which uses nonmagnetic single-component toner, that is, one of the dry developers, to develop an electrostatic latent image on an image bearing member will be described.

This image forming apparatus comprises: a cylindrical image bearing member (which hereinafter will be referred to as "photosensitive drum") 101 which is rotated in the direction indicated by an arrow mark p on the drawing to bear an electrostatic image; a charging device 102; an exposing device 103 for forming, on the photosensitive drum 101, an electrostatic latent image in accordance with a set of image formation data; a developing device (developing apparatus) 104; a transfer charging device 105; a fixing device 106; a cleaner 107; etc.

The developing apparatus 104 has a developer bearing member (which hereinafter will be referred to as "development roller") 110 with a diameter of 16 mm, which is rotated in the direction indicated by an arrow mark q at a peripheral velocity of 140 mm/sec to convey developer (which hereinafter may be referred to as "toner") to the peripheral surface of the photosensitive drum 101.

The development roller 110 is a so-called elastic development roller, which comprises an electrically conductive metallic core with a diameter of 8 mm, and an elastic member formed of rubber or the like around the peripheral surface of the metallic core. It is disposed in contact with the photosensitive drum 101.

The development roller 110 is also provided with a toner stripping-coating roller 111, a toner regulating blade, and a stirring member 113. The toner stripping-coating roller 111 plays the role of supplying the peripheral surface of the development roller 110 with nonmagnetic single-component toner as well as the role of stripping the toner from the peripheral surface of the development roller 110. It is rotated in the direction indicated by an arrow mark r at a peripheral velocity of 100 mm/sec. The toner regulating blade 112 regulates the amount by which the toner is allowed to remain on the peripheral surface of the development roller 110. The stirring member 113 comprises multiple stirring blades, and supplies the toner stripping-coating roller 111 with toner.

The developer stripping-coating roller 111 comprises a metallic supporting shaft with a diameter of 5 mm, and a layer of foamed substance formed around the peripheral surface of the metallic supporting shaft. The hardness of the developer stripping-coating roller 111 is less than that of the development roller 110. The developer stripping-coating roller 111 is disposed so that it is compressed 1 mm by the development roller 110 in the radius direction of the developer stripping-coating roller 111; the developer stripping-coating roller 111, which is less in hardness than the development roller 110, is deformed.

Referring to FIG. 1, as the photosensitive drum 101 is rotated in the arrow p direction, the peripheral surface of the photosensitive drum 101 is uniformly charged to the negative polarity by the charging device 102 to which voltage is being applied by a bias power source.

After being uniformly charged, the peripheral surface of the photosensitive drum 101 is exposed to a beam of laser light projected from the exposing device 103. As a result, an electrostatic latent image is formed on the peripheral surface of the photosensitive drum 101. This electrostatic latent image is developed into a visible image, that is, an image formed of toner (which hereinafter may be referred to as "toner image"), by the toner conveyed from the developer container 104 to the peripheral surface of the photosensitive drum 101, by the development roller 110 disposed in contact with the photosensitive drum 101.

Thereafter, the toner image on the peripheral surface of the photosensitive drum 101 is transferred by the transfer charging device 105 onto a transfer medium 108, for example, a piece of paper, OHP sheet, or the like, while the transfer medium 108 is conveyed. Then, the toner image on the transfer medium 108 is welded (fixed) to the transfer medium 108 by the fixing device 106.

The transfer residual toner particles, that is, the toner particles remaining on the peripheral surface of the photosensitive drum 101 after the transfer, are removed from the peripheral surface of the photosensitive drum 101 by the cleaner 107.

As for the toner particles which remained on the peripheral surface of the development roller 110, that is, the toner particles which were not consumed for the visualization of the latent image on the photosensitive drum 101 in the contact area between the development roller 110 and photosensitive drum 101, they are returned to the inside of the developing device 104 by the subsequent rotation of the development roller 110.

More specifically, in the contact area between the development roller 110 and developer stripping-coating roller 111, the toner particles on the peripheral surface of the development roller 110 are stripped away from the development roller 110 by the developer stripping-coating roller 111, falling into the developing device 104, while the toner particles in the developing device 104 are supplied on the peripheral surface of the development roller 110 by the developer stripping-coating roller 111. The toner particles supplied to the peripheral surface of the development roller 110 are conveyed to the contact area between the development blade 112 and development roller 110.

The above described process is repeated to form an image.

Known as an example of an image forming apparatus in which not only is the development roller greater in diameter than the developer stripping-coating roller, but also, the development roller is greater in hardness than the developer stripping-coating roller is the apparatus disclosed in Japanese Laid-open Patent Application 2002-108089, for example.

The image forming apparatus, shown in FIG. 1, employing a developing apparatus in accordance with the prior arts, was subjected to a durability test in which 10,000 copies were made using toner with a weight average particle diameter of 6 μm produced through pulverization and classification.

The toner contained an external additive; 1 part in weight of silica with a weight average particle diameter of roughly 50 nm was externally added to 100 parts in weight of toner.

During the test, at about the 5,000$^{th}$ copy, the so-called fog, that is, the phenomenon that toner adheres to the non-image points of the peripheral surface of the photosensitive drum, began to occur, and at about the 8,000$^{th}$ copy, the toner spill, that is, the phenomenon that toner particles fall off the peripheral surface of the development roller, began to occur.

The inventors of the present invention intensively searched for the causes of these phenomenon, making the following discoveries. That is, during the durability test, the external additive particles having been externally added to the toner were embedded in the surfaces of toner particles, making thereby the toner properties drastically different from those prior to the durability test (for example, toner was reduced in the amount of electric charge and the level of fluidity); in other words, the so-called toner deterioration occurred.

The cause of the above described toner deterioration is as follows.

In the contact area between the development roller and developer stripping-coating roller, the toner particles are subjected to the pressure resulting from the contact between the development roller and developer stripping-coating roller, and also, are rubbed by the two rollers because of the presence of the difference in peripheral velocity between the two rollers.

As the toner particles are rubbed by the peripheral surfaces of the development roller and developer stripping-coating roller while being subjected to this contact pressure, in the contact area, frictional force occurs between the toner particles and the peripheral surfaces of the two rollers, and a part of this frictional force is converted into frictional heat.

The generated frictional heat softens the toner particles. As a result, the external additive particles are embedded into the surfaces of the toner particles, deteriorating thereby the toner particles.

In particular, in the case of a contact type developing method in which a development roller is in contact with a photosensitive drum, toner particles are also subjected to frictional force in the contact area (development station), exacerbating the problem of the toner deterioration.

SUMMARY OF THE INVENTION

The primary object of the present invention is to provide a developing apparatus capable of maintaining a high level of development performance for a long period of time, by reducing developer deterioration by reducing the amount of the frictional force generated in the contact area between the developer bearing member and developer stripping-coating member of an image forming apparatus.

Another object of the present invention is to provide a developing apparatus which does not suffer from the problems of developer deterioration peculiar to a developing apparatus employing an elastic developer bearing member.

Another object of the present invention is to provide a developing apparatus suitable for developing an image with the use of an elastic developer bearing member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

For the purpose of minimizing developer deterioration (toner deterioration), it is effective to reduce the frictional force to which developer (toner) is subjected in the contact area between a developer bearing member (development roller) and a developer stripping-coating roller. Hereinafter, it will described in detail how the effects of the frictional force upon developer in the contact area are altered by the relationship between development roller radius and developer stripping-coating roller radius.

Figure 1:
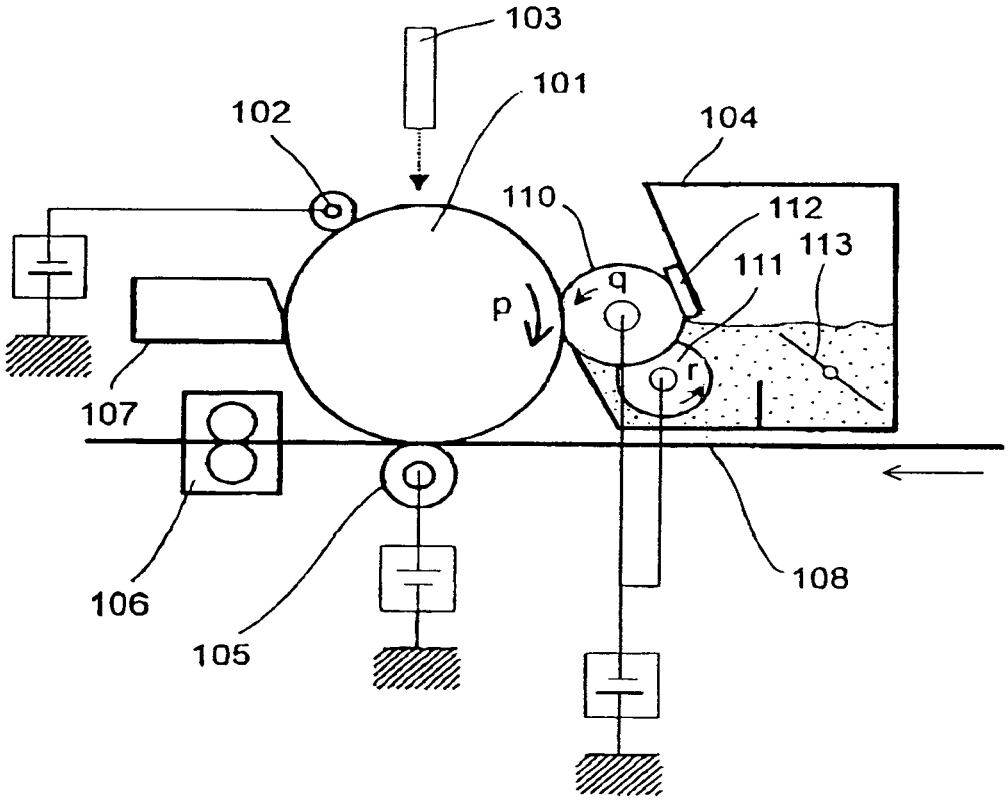
FIG. 1 PRIOR ART
FIG. 1 is a schematic sectional view of an image forming apparatus in accordance with the prior arts.
Figure 2:
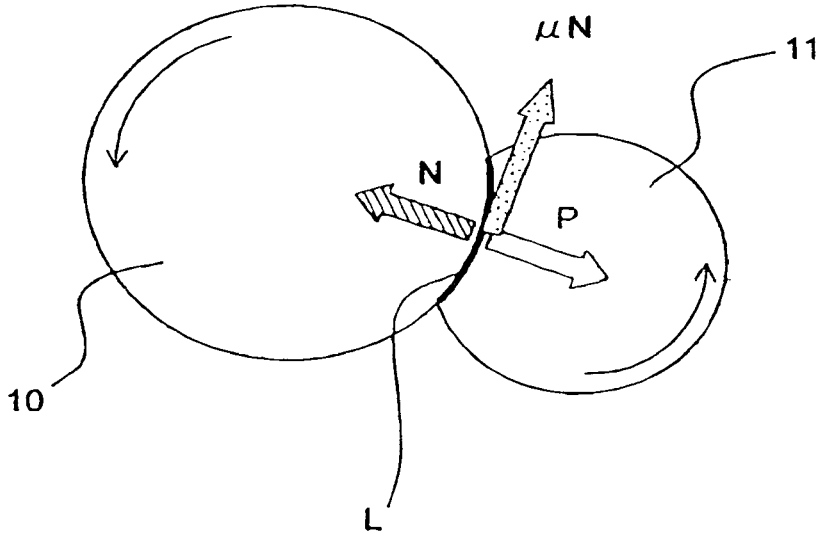
FIG. 2 is a schematic view of the development roller and developer stripping-coating roller, for describing the present invention.

FIG. 2 is a schematic sectional view of a development roller 10 and a developer stripping-coating roller 11, showing the state of the contact area between the two rollers. As will be evident from FIG. 2, the surface hardness of the developer stripping-coating roller 11 is less than that of the development roller 10.

In the case of the development roller 10 and developer stripping-coating roller 11 shown in FIG. 2, the two rollers 10 and 11 are rotationally driven independently from each other, at different peripheral velocities. Therefore, the friction in the contact area L (bold line in drawing) may be construed as sliding friction. Thus, the amount of the frictional force to which each toner particle is subjected in the minute space in the contact area L is the product of the friction coefficient (μ), the value of which is determined by the material for the development roller 10 and the material for the developer stripping-coating roller 11, and the force (N) to which the toner particle is subjected in the minute space in the contact area L, that is, the reactive force resulting from the stress P at the surface of the developer stripping-coating roller 11 (development roller 10); it is expressed as, μN.

Figure 3:
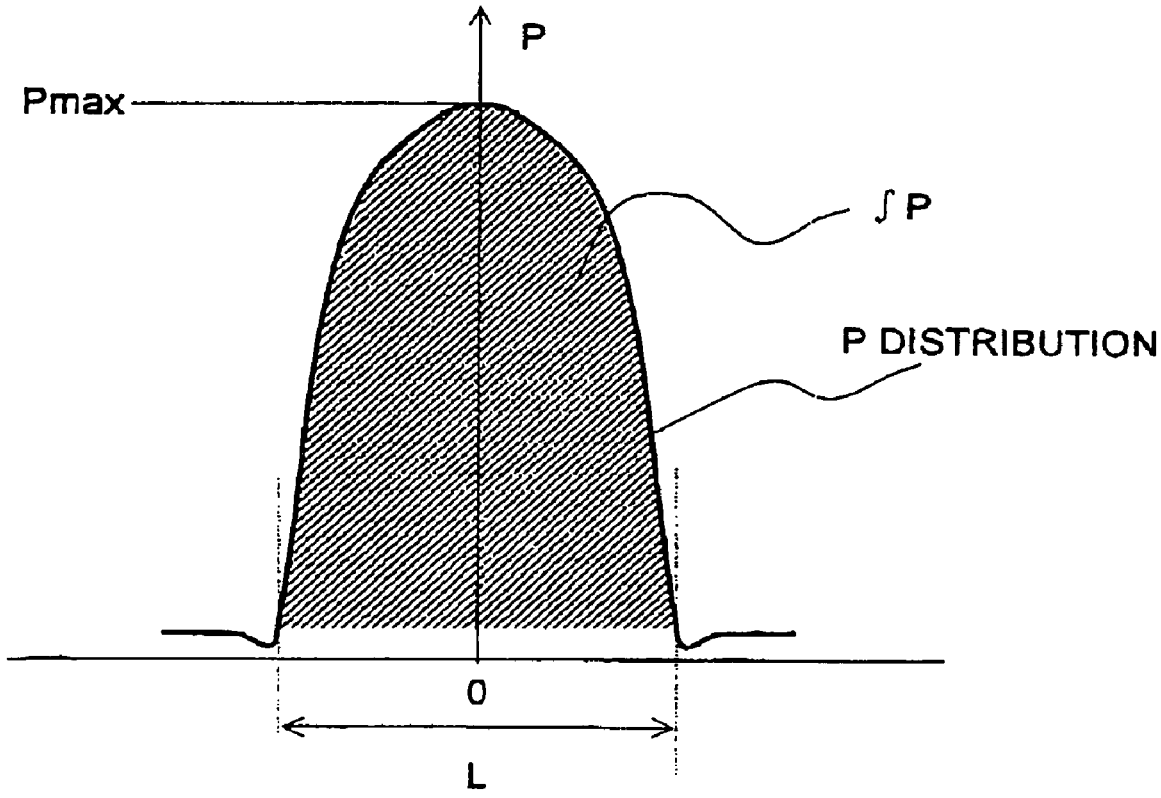
FIG. 3 is a graph showing a stress distribution curve, for describing the present invention.

The distribution of the stress P in the contact area L is as shown in FIG. 3. Thus, the total amount of the frictional force, to which each toner particle is subjected in the contact area L can be obtained as the product of the value of the hatched area in FIG. 3 and the friction coefficient μ. The value of the hatched area is obtainable by integrating the numerical expression of the distribution curve of the stress P in FIG. 3, within the range L (which corresponds to the contact areas L).

In other words, the frictional force=$\mu\int N=\mu\int P$.

Therefore, reducing the amount of the stress P itself, and/or the size of the contact area L, that is, the integration interval, is effective to reduce the amount of the frictional force to which each toner particle is subjected in the contact area L.

The present invention is characterized in that the above described frictional force is reduced by reducing the amount of the stress P and the size (width) of the contact area L by skillfully choosing the values for the radii of the development roller 10 and developer stripping-coating roller 11.

Figure 4:
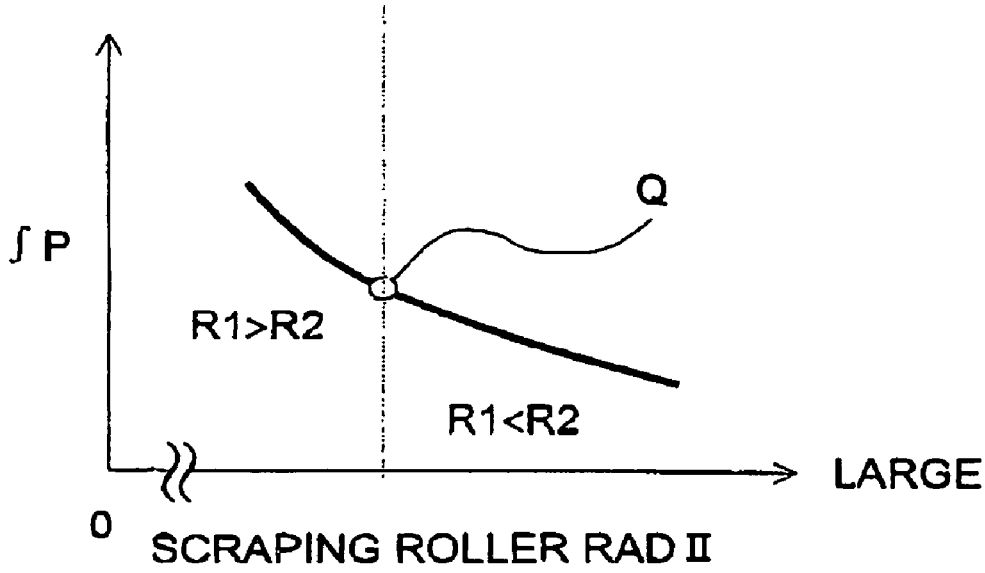
FIG. 4 is a graph showing the relationship between the total amount of the stress and radius of the developer stripping-coating roller, for describing the present invention.
Figure 4:
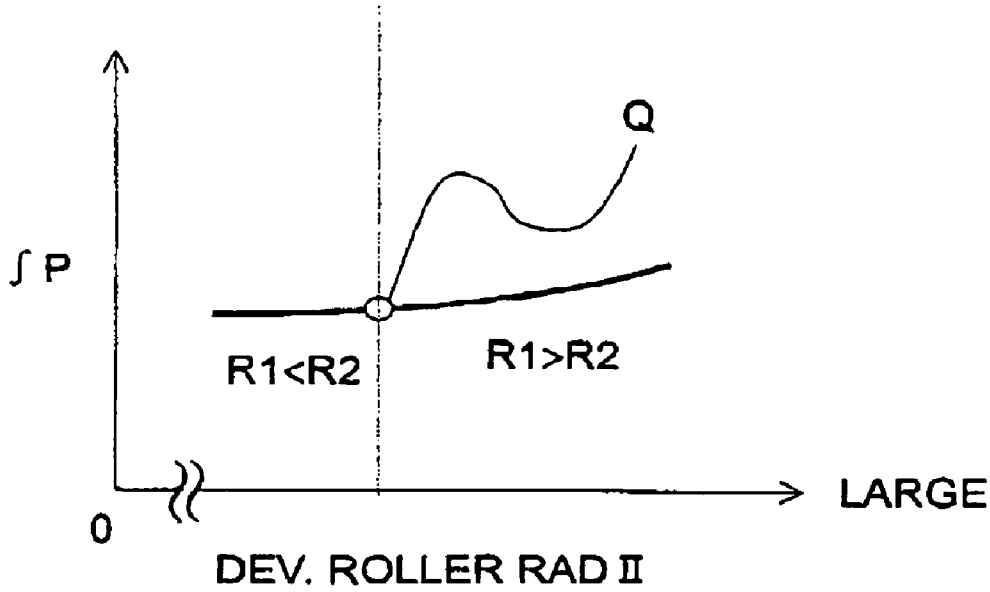
Figure 5:
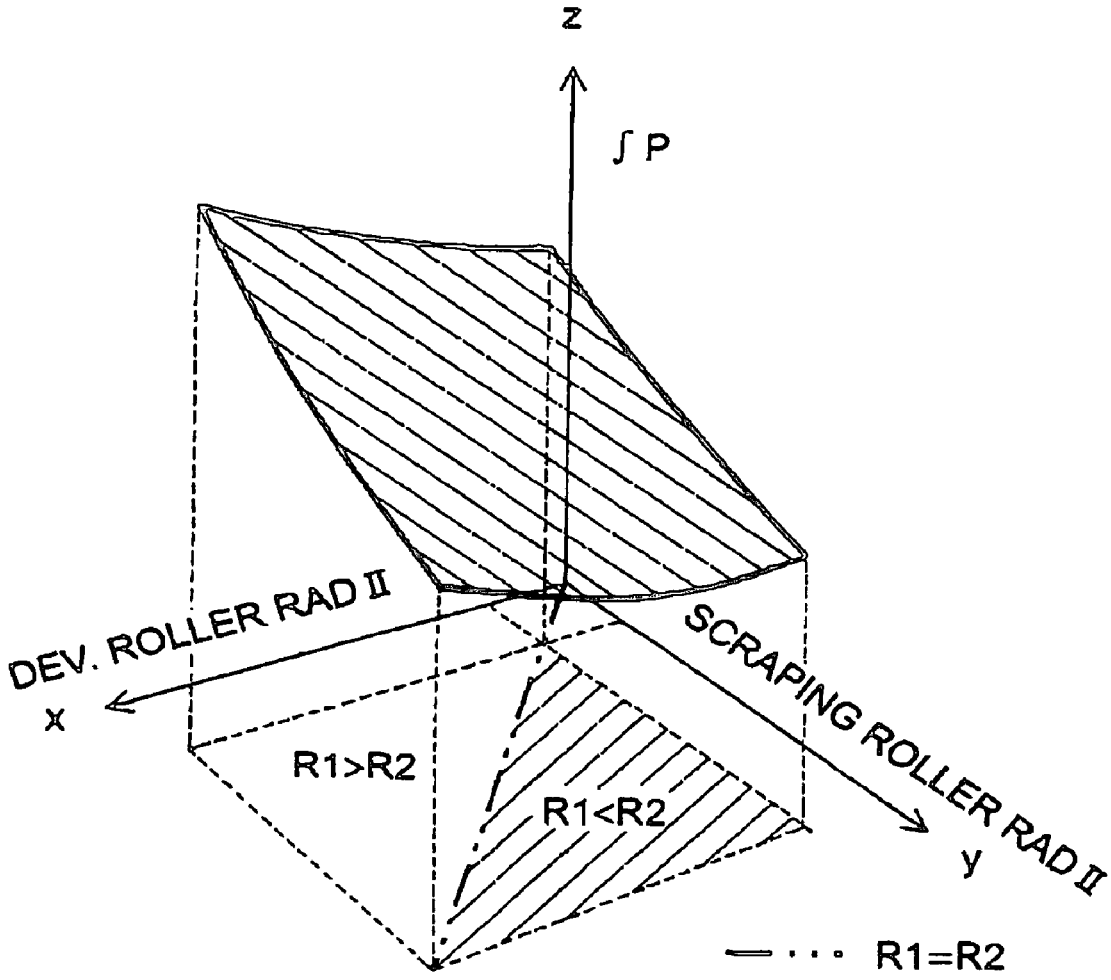
FIG. 5 is a graph showing the relationship among the total amount of the stress, radius of the development roller, and radius of the developer stripping-coating roller, for describing the present invention.

FIGS. 4 and 5 are graphs showing the changes in the value of ∫P which occurred as the development roller 10 was changed in radius, and the changes in the value of ∫P which occurred as the developer stripping-coating roller 11 was changed in radius, respectively.

FIG. 4(*a*) is a graph showing the changes in the value of ∫P which occurred as the radius R2 of the developer stripping-coating roller 11 was changed while the radius R1 of the development roller 10 was kept unchanged (abscissa represents the radius R2 of developer stripping-coating roller 11, and ordinate represents the value of ∫P). A point Q in the graph is where the value of the radius R1 of the development roller 10 coincides with that of the radius R2 of the developer stripping-coating roller 11 (R1=R2).

Conversely, FIG. 4(*b*) is a graph showing the changes in the value of ∫P which occurred as the radius R1 of the development roller 10 was changed while the radius R2 of the developer stripping-coating roller 11 was kept unchanged. A point Q in the graph is where the value of the radius R1 of the development roller 10 coincides with that of the radius R2 of the developer stripping-coating roller 11 (R1=R2), as is the point Q in FIG. 4(*a*).

FIG. 5 is a three dimensional graph in which the X axis represents the radius R1 of the development roller 10; the Y axis represents the radius R2 of the developer stripping-coating roller 11; and the Z axis represents ∫P. In the graph, the two-dot broken line on a plane XY (plane which includes both X and Y axes) represents where the radii of the development roller 10 and developer stripping-coating roller are the same (R1=R2).

Incidentally, the radii of the development roller 10 and developer stripping-coating roller 11 are adjusted by increasing or reducing the rollers in the thickness of the elastic layer while keeping them constant in the radius of the supporting shaft. Further, the depth of the apparent entry of the developer stripping-coating roller 11 into the development roller 10, and vice versa, are kept constant.

In this patent application, the radii of curvature of the development roller 10 and developer stripping-coating roller 11 means the values of the radii of curvature of the development roller 10 and developer stripping-coating roller 11 with the presence of no contact between the two rollers. In other words, they mean the values of the radii of curvature of the development rollers 10 and 11 when the portion of the peripheral surface of the development roller 10 and the portion of the peripheral surface of the developer stripping-coating roller 11, corresponding to the area in which the peripheral surfaces of the development roller 10 and developer stripping-coating roller 11 make contact with each other, are not in the temporarily deformed state.

In the following description of the interaction between the two rollers, in the contact area between the two rollers, when the two rollers are not in contact with each other, the radii of curvature of the two rollers are the same as the radii of the two rollers, respectively.

According to FIGS. 4 and 5, the greater the radius of the developer stripping-coating roller 11, the smaller the integral ∫P of the stress P in the contact area. Also, the smaller the radius of the development roller 10, the smaller the integral ∫P of the stress P in the contact area. These tendencies are particularly conspicuous, that is, the integral ∫P is substantially smaller, under the condition that the radius R1 of the development roller 10 is smaller than the radius R2 of the developer stripping-coating roller 11 (R1<R2).

These tendencies are attributable to the following mechanism.

Figure 6:
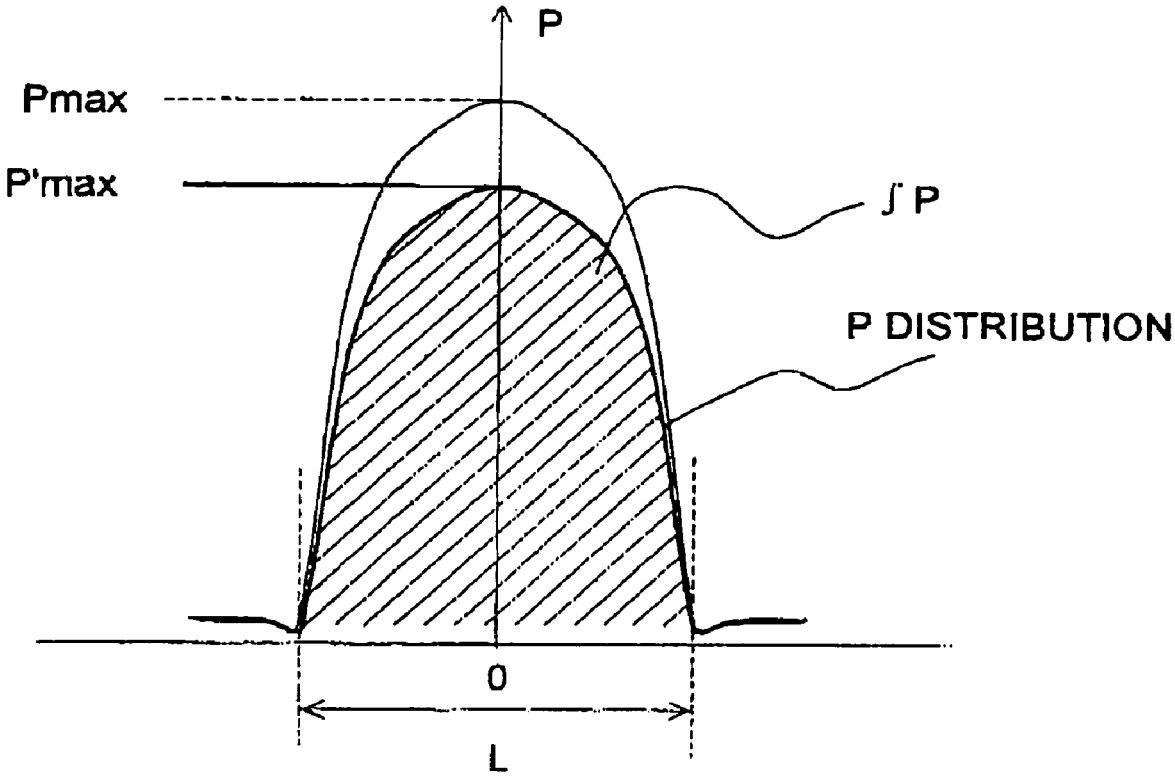
FIG. 6 is a graph showing the stress distribution curve, for describing the present invention.

(1) As the radius R2 of the developer stripping-coating roller 11 is increased without changing the radius R1 of the development roller 10, the maximum value Pmax of the stress P reduces to a value P'max as shown in FIG. 6, which shows the distribution of the stress P, reducing thereby the integral ∫P of the stress P. In this case, it is reasonable to speculate that the interval L in the graph, corresponding to the width of the contact area L, in which the stress P is integrated, widens, because the increase in the radius R2 of the developer stripping-coating roller 11 increases the width of the contact area, that is, the dimension of the contact area in terms of the circumferential direction of the development roller 10. In reality, however, the increase in the width of the contact area is not much; on the contrary, the contact area sometimes reduces in width. The reason therefor will be described next with reference to FIGS. 8–10.

Figure 8:
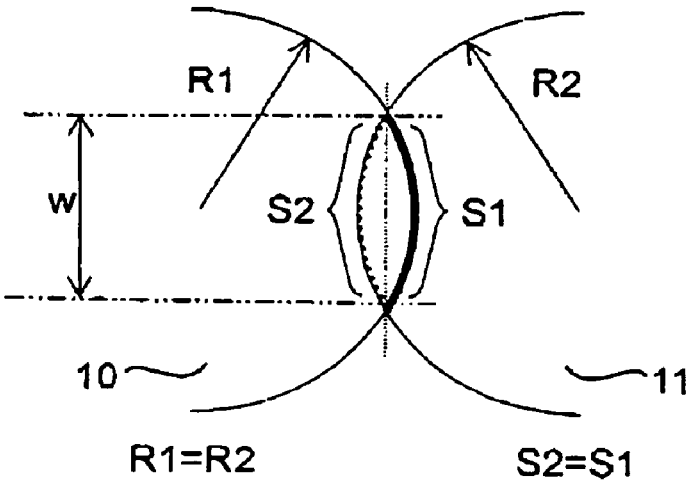
FIG. 8 is a schematic sectional vies of the contact area, and its adjacencies, between the development roller and developer stripping-coating roller, for describing the present invention.
Figure 9:
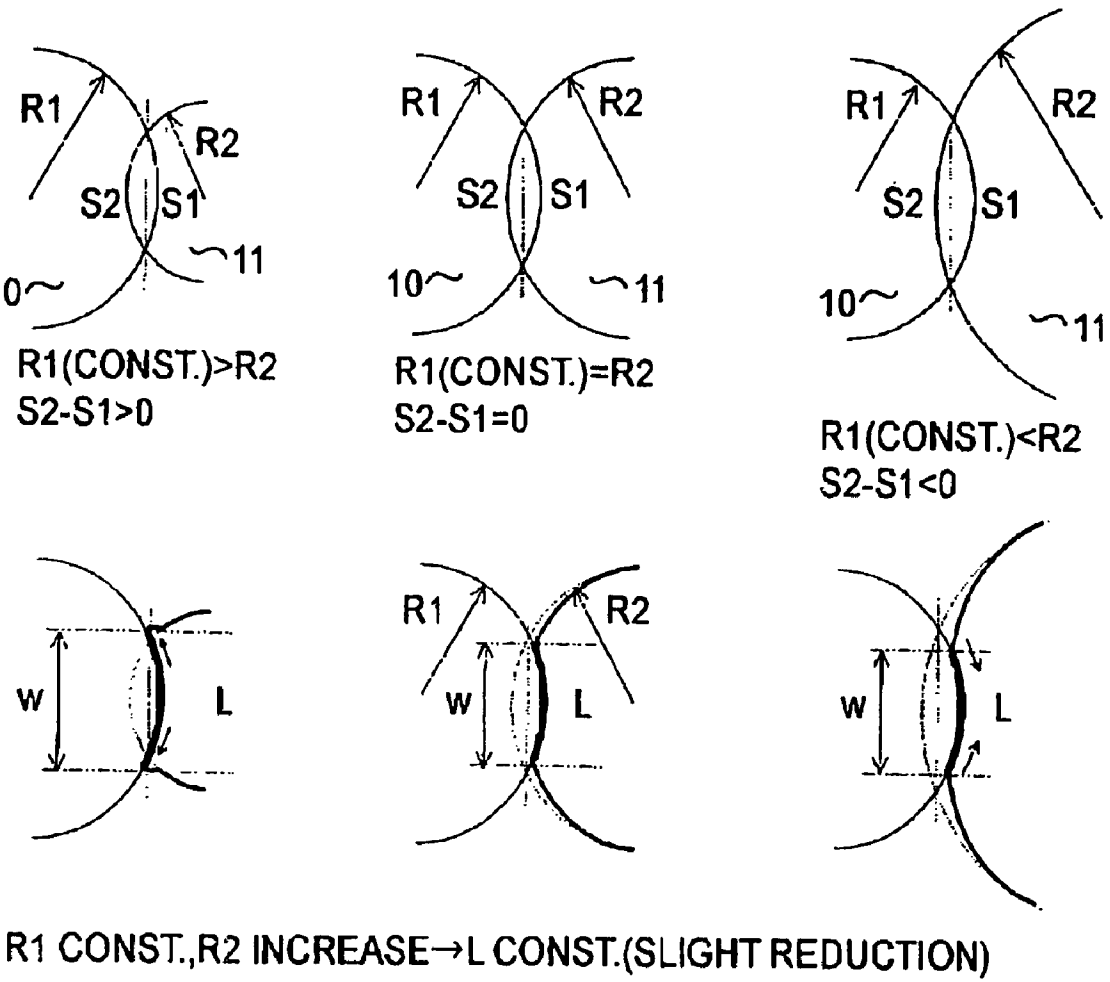
FIG. 9 is a schematic sectional view of the contact area, and its adjacencies, between the development roller and developer stripping-coating roller, for describing the present invention.
Figure 10:
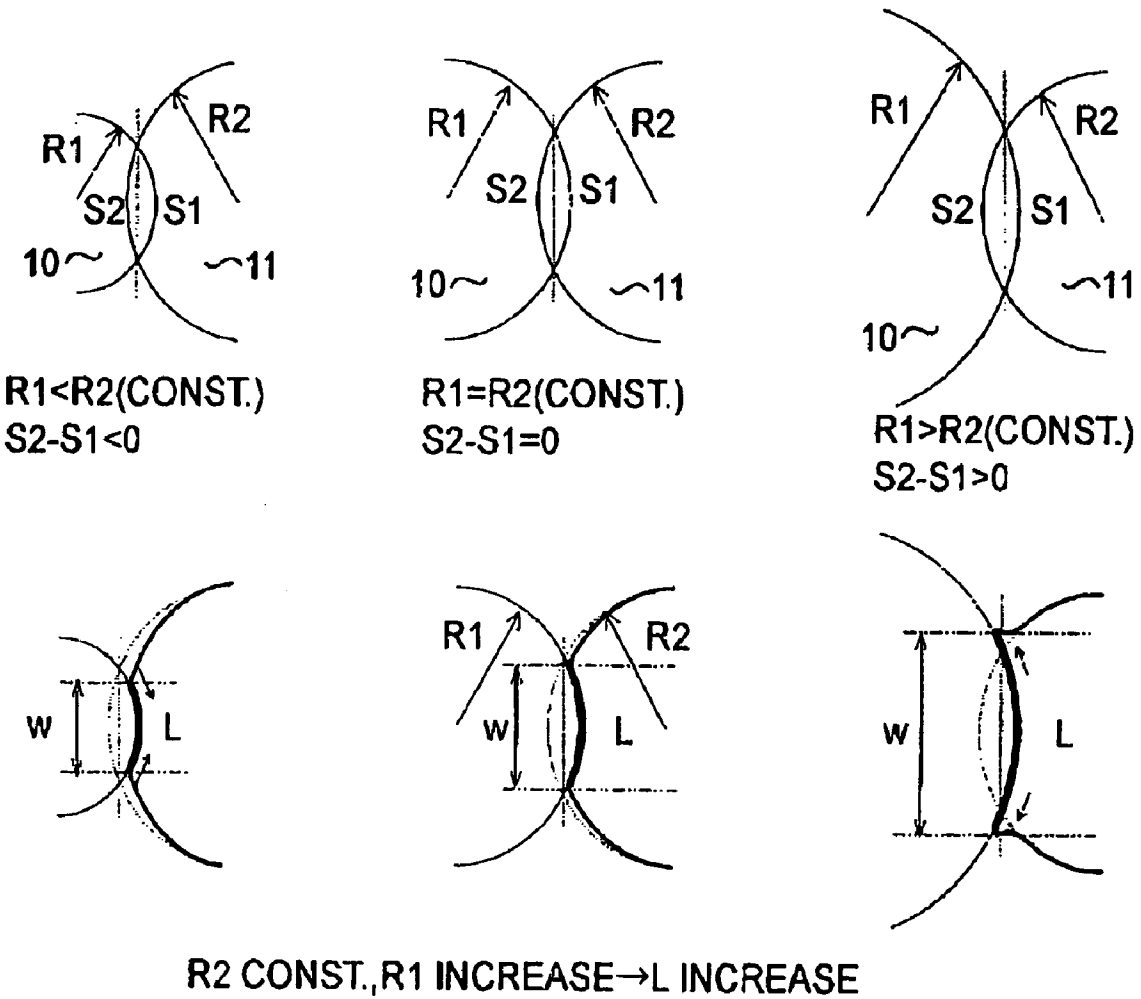
FIG. 10 is a schematic sectional view of the contact area, and its adjacencies, between the development roller and developer stripping-coating roller, for describing the present invention.

FIGS. 8–10 are schematic sectional views of the contact area, and its adjacencies, between the development roller 10 and developer stripping-coating roller 11. The developer stripping-coating roller 11 is less in hardness than the development roller 10. Therefore, it is the developer stripping-coating roller 11 that deforms; the surface layer of the developer stripping-coating roller 11 conforms to the contour of the development roller 10. In the drawings, S1 represents the circumferential length of the contact area between the development roller 10 and developer stripping-coating roller 11, and S2 represents the circumferential length of the portion of the peripheral surface of the developer stripping-coating roller 11 deformed by the development roller 10 (W represents direct distance between one edge of the contact area, in terms of the circumferential direction, to the other).

FIG. 8 shows the case in which the development roller 10 and developer stripping-coating roller 11 are the same in radius (R1=R2). In this case, S1=S2.

In comparison, when the radius R1 of the development roller 10 is greater than the radius R2 of the developer stripping-coating roller 11 (R1>R2) as shown in the bottom portion of FIG. 9, S1 is shorter than S2, that is, the portion of the peripheral surface of the developer stripping-coating roller 11 deformed by the development roller 10. In other words, S1 is excessive relative to S1. In addition, the developer stripping-coating roller 11 is less in hardness than the development roller 10, being therefore greater in the amount of deformation than the development roller 10. Therefore, the portion of the developer stripping-coating roller 11 corresponding to the contact area is partially pushed out of the contact area, from both edges, by the amount corresponding to the aforementioned excess (S2 S1), expanding thereby the contact area, that is, increasing the width of the contact area L in terms of the circumferential direction. Thus, under the condition that the radius of the development roller 10 is greater than that of the developer stripping-coating roller 11 (R1>R2), the smaller the R2, the greater the difference (S2−S1), and therefore, the more conspicuous this phenomenon. Therefore, the reduction in the radius R2 of the developer stripping-coating roller 11 does not substantially reduce the width of the contact area L.

On the other hand, under the condition that the radius R2 of the developer stripping-coating roller 11 is greater than the radius R1 of the development roller 10 (R1<R2) as shown in the top portion of FIG. 9, S1 is greater than S2. Since the developer stripping-coating roller 11 is less in hardness than the development roller 10, being therefore greater in the amount of deformation than the development roller 10, the portion of the peripheral portion of the developer stripping-coating roller 11 corresponding to the contact area L is pulled toward the center of the contact area L, at both edges, because S2<S1. Therefore, increasing the radius R2 of the developer stripping-coating roller 11 does not substantially increase the width of the contact area L.

As will be evident from the above explanation, in theory, if the radius R2 of the developer stripping-coating roller 11 is increased without changing the radius R1 of the development roller 10, the circumferential length S1 of the contact area L increases. In reality, however, the length S1 of the contact area L does not substantially increase, remaining virtually the same.

On the other hand, the amount of the stress P in the contact area is likely to be affected by the metallic core of the developer stripping-coating roller 11, because the elastic layer of the developer stripping-coating roller 11 is less in hardness than the development roller 10. Thus, if the radius R2 of the developer stripping-coating roller 11 is increased (by increasing the thickness of the elastic layer of the developer stripping-coating roller 11) without changing the depth by which the developer stripping-coating roller 11 is compressed in the radius direction of the developer stripping-coating roller 11 by the development roller 10, the effect of the metallic core of the developer stripping-coating roller 11 upon the amount of the stress P becomes smaller, which in turn reduces the maximum value Pmax of the stress P. In other words, if the radius R2 of the developer stripping-coating roller 11 is increased without changing the radius R1 of the development roller 10, the integral ∫P of the stress P reduces as shown in FIG. 6.

(2) This is the case in which the radius R1 of the development roller 10 is increased without changing the radius R2 of the developer stripping-coating roller 11. Under the condition that the radius R1 of the development roller 10 is larger than the radius R2 of the developer stripping-coating roller 11 as shown in the top right portion of FIG. 10 (R1>R2), the greater the radius R1, the greater the difference (S2−S1). Therefore, the portion of the periphery of the developer stripping-coating roller 11, corresponding in position to the contact area L (S2), which is softer and more deformable than the corresponding portion of the development roller 10, is pushed out of the contact area by the amount proportional to the difference (S2−S1) from both edges of the contact area, expanding thereby the contact area L (increasing the length S2), as shown in the bottom right portion of FIG. 10. In other words, the direction in which the circumferential length S1 is increased by the increase in the radius R1 of the development roller 10 coincides with the direction in which the portion of the periphery of the developer stripping-coating roller 11, corresponding in position to the contact area, is squeezed out of the theoretical contact area. Therefore, the width of the actual contact area L increases.

On the contrary, under the condition that the radius R1 of the development roller 10 is smaller than the radius R2 of the developer stripping-coating roller 11 (R1<R2) as shown in the top left portion of FIG. 10, the smaller the radius R1, the greater the amount of the force, by which the portion of the periphery of the developer stripping-coating roller 11, corresponding in position to the contact area, which is softer and more deformable than the portion of the periphery of the development roller 10, is pulled toward the center of the contact area. Therefore, the contact area L is likely to be reduced in length, being shorter than the theoretical length (bottom left in FIG. 10).

Figure 7:
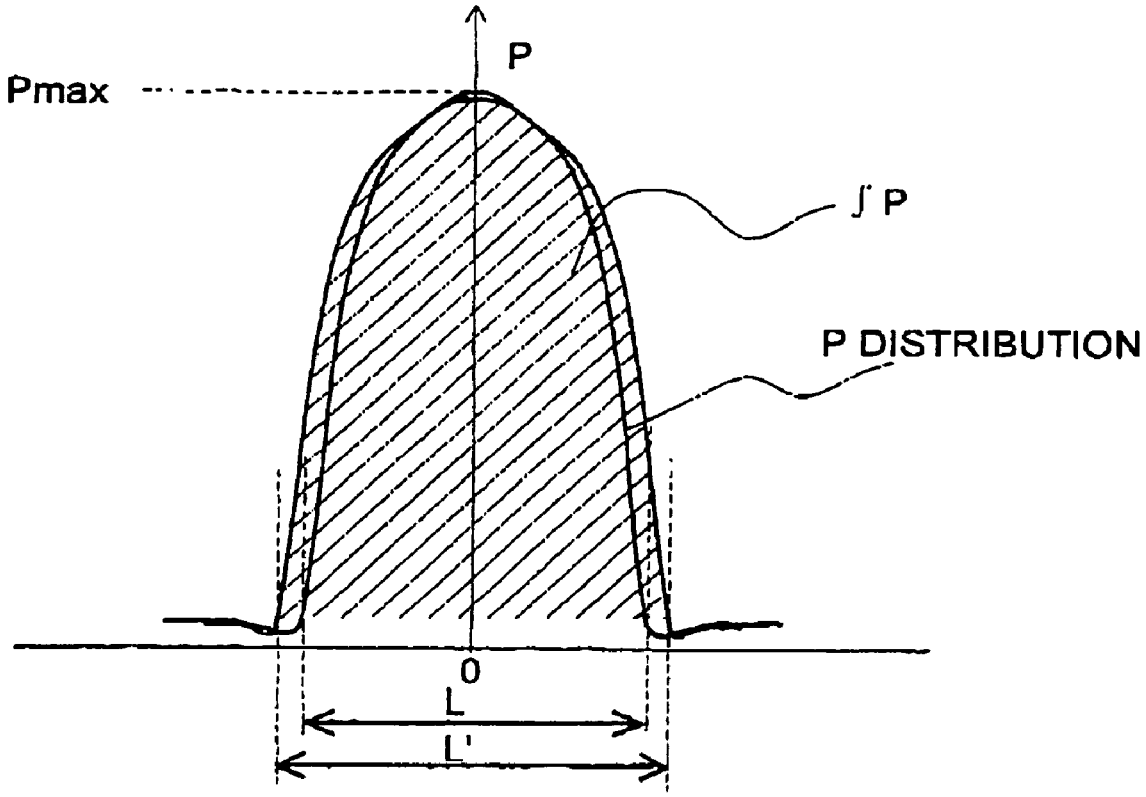
FIG. 7 is another graph showing the stress distribution curve, for describing the present invention.

As will be evident from the above explanation, if the radius R1 of the development roller 10 is increased without changing the radius R2 of the developer stripping-coating roller 11, the width of the contact area L is likely to increase, as shown in FIG. 7, from the theoretical length to the actual length L'.

Further, the hardness of the development roller 10 is greater than that of the developer stripping-coating roller 11. Therefore, even if the development roller 10 is changed in the thickness of the elastic layer, in order to change the development roller 10 in radius, the maximum value Pmax of the stress P in the contact area barely changes. Therefore, as the radius R1 of the development roller 10 is increased without changing the R2 of the developer stripping-coating roller 11, the integral ∫P is likely to increase as shown in FIG. 7.

FIG. 5 shows the changes which occurred to the integral ∫P as the radius R1 of the development roller 10 and radius R2 of the developer stripping-coating roller 11 were independently changed while taking into account the results in (1) and (2). It is evident from this graph that the greater the radius R2 of the developer stripping-coating roller 11, and the smaller the R1 of the development roller 10, the smaller the integral ∫P of the stress P.

In other words, combining a developer stripping-coating roller with a development roller smaller in radius (R1) than the developer stripping-coating roller is effective to reduce the integral ∫P of the stress P. As will be evident from the above explanation, the toner deterioration which occurs in the contact area L between a development roller and a developer stripping-coating roller can be reduced by reducing the total amount of the frictional force, that is, ∫P, to which a toner particle is subjected in the contact area, and the total amount of the frictional force can be reduced by controlling the width of the contact area L, and the amount (maximum value Pmax) of the stress P, which can be controlled by controlling the relationship between the radius R1 of the development roller and the radius R2 of the developer stripping-coating roller. In other words, the toner deterioration can be reduced by optimizing the relationship between the radius R1 of the development roller and the radius R2 of the developer stripping-coating roller.

Further, even if a developer bearing member and/or a developer stripping-coating member is not in the truly cylindrical form, for example, even if one or both of them are in the form of a belt, which is not uniform in curvature across its circumference, as long as the relationship between the radii of curvature of the portions of the developer bearing member and developer stripping-supplying member, corresponding in position to the contact area between the two members, satisfies an inequality: radius of curvature of developer stripping-coating member>radius of curvature of developer bearing member, the same effects as those described can be obtained; in other words, the frictional force to which a toner particle is subjected can be reduced to reduce toner deterioration.

As described above, the toner deterioration attributable to the frictional force, to which a toner particle is subjected in the contact area between a developer bearing member and a developer stripping-supplying member, can be reduced by reducing the total amount of the stress in the contact area, which is equivalent to the integral ($=\int(\mu N)ds$) of the distribution curve of the stress generated in the contact area.

Hereinafter, the preferred embodiments of the present invention will be described in detail with reference to the appended drawings. Incidentally, the measurements, materials, and shapes of the structural components of the image forming apparatuses in the following embodiments of the present invention, and their positional relationships, are not intended to limit the scope of the present invention, unless specifically noted.

Embodiment 1

First, referring to FIG. 11, the first embodiment of the present invention will be described.

Figure 11:
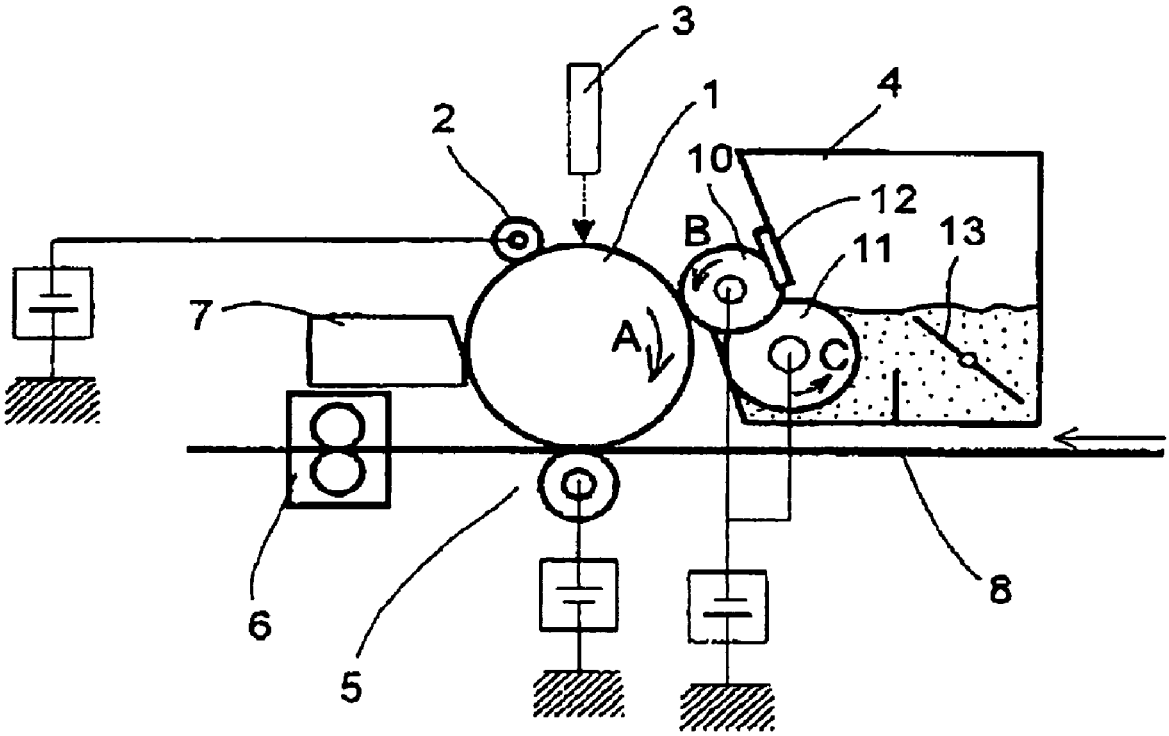
FIG. 11 is a schematic sectional view of the image forming apparatus in the first embodiment of the present invention.

The developing apparatus in this embodiment shown in FIG. 11 is of a reversal development type, which develops an latent image on the image formation area of the photosensitive drum 1 as an image bearing member, into a visible image, by adhering developer to the image formation area. It comprises a development roller 10, as a developer bearing member, on which negatively charged toner is to be borne, and which is placed in contact with the photosensitive drum 1, for development. In other words, the developing apparatus is a contact type developing apparatus which employs a single-component developer.

The image forming apparatus employing the above described developing apparatus is equipped with a cylindrical photosensitive drum 1, which is 24 mm in diameter and is rotationally driven at a peripheral velocity of 90 mm/sec in the direction indicated by an arrow mark A in the drawing. Disposed around the peripheral surface of the photosensitive drum 1 are a charging device 2, an exposing device 3, a developing device (developing apparatus) 4, a charging device 5 for transfer, and a cleaner 7, which are listed from the upstream side in terms of the rotational direction of the photosensitive drum 1, that is, listed following the order of usage in image formation. The image forming apparatus is also provided with a fixing device 6.

Next, the image forming operation of this image forming apparatus will be described in general terms.

First, the peripheral surface of the photosensitive drum 1 being rotated in the arrow A direction is uniformly charged to negative polarity by the charging device 2 connected to a bias power source. Then, a set of image formation data is written as an electrostatic latent image on the peripheral surface of the photosensitive drum 1, by exposing the charged peripheral surface of the photosensitive drum 1 with the use of the exposing device 3 which projects a beam of light, for example, a beam of laser light.

The developing device 4 is provided with an elastic development roller 10 rotatable at a peripheral velocity of 140 mm/sec in the direction indicated by an arrow mark B. The toner coated on the peripheral surface of the development roller 10 is conveyed by the rotation of the development roller 10 to the contact area between the photosensitive drum 1 and development roller 10, in which an image reflecting the latent image is formed of toner on the peripheral surface of the photosensitive drum 1, because of the relationship in potential level between the development roller 10, to which DC voltage is being applied from a bias power source, and the latent image on the photosensitive drum 1.

The charging device 5 for image transfer is disposed so that a transfer medium 8 will be nipped between the peripheral surface of the photosensitive drum 1 and the transfer charging device 5. The transfer charging device 5 is connected to a bias power source. As voltage opposite in potential to the toner is applied to the transfer charging device 5 from the bias power source, the toner image on the photosensitive drum 1 is transferred onto the transfer medium 8 being conveyed between the photosensitive drum 1 and transfer charging device 5.

After the transfer of the toner image onto the transfer medium 8, the transfer medium 8 is conveyed to the fixing device 6. In the fixing device 6, the toner image is welded (fixed) to the transfer medium 8.

The transfer residual toner, that is, the toner remaining on the peripheral surface of the photosensitive drum 1 after the transfer, is recovered by the cleaner 7.

An image is completed by repeating the above described process.

Next, the details of the structure and operation of the developing device 4 will be described.

The developing device 4 is provided with an elongated opening, which extends in the lengthwise direction of the developing device 4. The elastic development roller 10 of the developing device 4, which is rotatable at the peripheral velocity of 140 mm/sec in the arrow B direction, is disposed so that it is placed in contact with the photosensitive drum 1 through the opening.

The developing device 4 is also provided with: a developer stripping-coating roller 11 (rotatable at peripheral velocity of 100 mm/sec in direction indicated by arrow mark C) as a member for stripping developer from the development roller 10, on one side of the nip between the development roller 10 and photosensitive drum 1, while coating the development roller 10 with developer, on the other side; a regulating blade 12 as a toner amount regulating member disposed in contact with the development roller 10 with the application of a predetermined amount of pressure; and a stirring member 13 in the form of a blade (which is rotated in direction indicated by arrow mark E) for conveying toner while stirring it. Further, nonmagnetic single-component toner is stored in the developing device 4.

In this embodiment, nonmagnetic single-component toner manufactured with the use of the pulverization process and classification process is employed as the developer. Its particles are aspherical and 6 μm in average diameter. As the developer, a mixture of 100 parts in weight of this toner and 1 parts in weight of silica which is roughly 50 nm in weight average diameter is employed (the same developer as those employed by the image forming apparatuses in accordance with the prior arts is employed).

The development roller 10 in this embodiment is flexible. More specifically, it is a cylindrical elastic member comprising: a metallic supporting shaft; a roughly 4 mm thick elastic layer formed of solid rubber, sponge, or the like (which in this embodiment is butadiene rubber) on the peripheral surface of the metallic supporting shaft; and the surface layer (which in this embodiment is 30 μm thick urethane film) coated on the peripheral surface of the elastic layer to give electric charge to toner. It is 16 mm in diameter, and roughly 45° in Asker hardness scale C. In other words, the material for this development roller 10 is the same as those for the development rollers in accordance with the prior arts.

The developer stripping-coating roller 11 is also flexible. More specifically, it comprises: a metallic supporting shaft with a diameter of 5 mm; and a cylindrical elastic member formed of foamed urethane, in which pores are interconnected, on the peripheral surface or the metallic core. Its diameter is 18 mm. The reason for the employment of foamed substance as the material for the elastic layer of the developer stripping-coating roller 11 is to provide the peripheral surface of the roller 11 with numerous open pores, in order to supply the development roller 10 with a sufficient amount of toner. Since the elastic layer of the developer stripping-coating roller 11 is formed of foamed substance, the hardness of the surface of the developer stripping-coating roller 11 is substantially lower compared to that of the development roller 10. The substances employed as the materials for the developer stripping-coating roller 11 in this embodiment are the same as those for the developer stripping-coating rollers in accordance with the prior arts.

Incidentally, the hardness of the developer stripping-coating roller 11 formed of foamed substance was too low to be measured on Asker hardness scale C in which the hardness of the development roller 10 is measured. Therefore, it was measured in Asker hardness scale F used as the hardness index for substances substantially softer than the development roller 10, and was roughly 70°. Although the surface hardness of the development roller 10 and that of the developer stripping-coating roller 11 were expressed in different hardness scales, it is obvious that the surface hardness of the developer stripping-coating roller 11 is lower than that of the development roller 10.

The development roller 10 and developer stripping-coating roller 11 are both cylindrical. Therefore, when the two rollers are not in contact with each other, the radii of curvature of the portions of the development roller 10 and developer stripping-coating roller 11, corresponding in position to the contact area, are the same as the radii of the two rollers 10 and 11, respectively, which are 8 mm and 9 mm, respectively.

The depth by which the development roller 10 compresses the developer stripping-coating roller 11 in the radius direction of the development roller 10 is 1.0 mm. The depth by which the development roller 10 compresses the developer stripping-coating roller 11 in the radius direction of the development roller 10 is set to be no more than the thickness of the elastic member of the developer stripping-coating roller 11 in order to prevent the metallic cores of the two rollers from coming into contact with each other.

In the developing device 4, the stirring member 13 conveys the toner to the adjacencies of the developer stripping-coating roller 11. The toner in the adjacencies of the developer stripping-coating roller 11 is conveyed by the rotation of the developer stripping-coating roller 11 to the contact area between the development roller 10 and developer stripping-coating roller 11, in which the toner is borne on the peripheral surface of the development roller 10.

Then, the toner having just been borne on the peripheral surface of the development roller 10 is conveyed by the subsequent rotation of the development roller 10 to the contact area between the development roller 10 and regulating blade 12, and is conveyed through the contact area. While the toner is conveyed through the contact area, not only is the body of toner on the peripheral surface of the development roller 10 negatively charged by the friction between the toner and regulating blade 12, and the friction between the toner and development roller 10, but also is formed into a toner layer of a uniform thickness.

After being uniformly coated on the peripheral surface of the development roller 10, the toner is conveyed to the contact area (development station) between the photosensitive drum 1 and development roller 10, in which when there is a latent image on the photosensitive drum 1, the toner is adhered to the photosensitive drum 1, that is, develops the latent image, whereas when there is no latent image on the photosensitive drum 1, the toner remains on the development roller 10 to be returned to the developing device 4.

The toner having remained on the development roller 10 and returned to the developing device 4 is stripped from the development roller 10 by the developer stripping-coating roller 11 which is being rotated at a predetermined peripheral velocity which is different from the peripheral velocity at which the development roller 10 is being rotated. The toner having just been stripped by the developer stripping-coating roller 11 joins the toner in the developer container after being conveyed through the contact area between the developer stripping-coating roller 11 and development roller 10.

In order to strip the toner particles on the development roller 10, which were not involved in the development, from the development roller 10, there needs to be a difference in peripheral velocity between the development roller 10 and developer stripping-coating roller 11, in the contact area between the two rollers. If the developer stripping-coating roller 11 is increased in peripheral velocity to provide the difference in peripheral velocity between the developer stripping-coating roller 11 and development roller 10, in the contact area, the amount by which toner is conveyed through the contact area per unit of time is increased, increasing thereby the amount of the frictional force which the toner receives while being conveyed through the contact area. Thus, the peripheral velocity of the developer stripping-coating roller 11 is desired to be as low as possible within the range in which the development roller 10 can be supplied with a sufficient amount of toner, and also, in which the peripheral velocity of the development roller 10 is greater than that of the developer stripping-coating roller 11. In this embodiment, the peripheral velocities of the development roller 10 and developer stripping-coating roller 11 are set to 140 mm/sec and 100 mm/sec, respectively, and the rotational directions of the two rollers are set so that their peripheral surfaces move in the opposite directions, in the contact area.

In the durability tests, similar to those in accordance with the prior arts, carried out by the inventors of the present invention, in which toner, the particles of which are aspherical and are 6 μm in weight average diameter was used, and 10,000 copies were printed, the problems such as fog formation, toner spilling, etc., associated with the developing apparatus in accordance with the prior arts did not occur; preferable images were continuously formed until the last copy was produced.

The inventors of the present invention carried out another durability test, in which the toner, the particles of which are aspherical and are 6 μm in weight average diameter was used; 1,000 copies were printer; and various factors in this embodiment, that is, beginning with the above described structural arrangements, the radius of the developer stripping-coating roller 11, etc., were varied as shown in the following table. The results are given in the following table (Table 1).

The radius of the developer stripping-coating roller 11 was varied by changing the thickness of the elastic layer formed of a foamed substance without changing the diameter (5 mm) of its metallic core. The positional relationship between the development roller 10 and developer stripping-coating roller 11 was set so that the depth by which the developer stripping-coating roller 11 was compressed by the development roller 10 in the radius direction of the developer stripping-coating roller 11 became 1.0 mm.

Further, an arrangement was made so that the peripheral velocities of the development roller 10 and developer stripping-coating roller 11 relative to each other (which in this embodiment was 240 mm/sec), in the contact area, remained the same despite the changes in the radius of the developer stripping-coating roller 11.

TABLE 1

| | ROLLER RADII (mm) | | | | | | |
|---|---|---|---|---|---|---|---|
| | 4 | 5 | 6 | 7 | 8 | 9 | 10 |
| RADIUS DEV. ROLLER 8 (mm) | N | N | N | F | G | G | G |

G: No image defect
F: Fog is produced
N: Toner falls

In Table 1, G means that there was no problem throughout the durability tests (preferable images were formed from the beginnings of the tests to the ends); F means that fog was generated during the durability tests (toner adhered to non-image points of the peripheral surface of the photosensitive drum); and N means that not only was fog generated, but also, "toner spill", that is, the phenomenon that toner particles not carrying a sufficient amount of electric charge spill from the development roller 10, occurred.

It is evident from Table 1 that the smaller the radius of the developer stripping-coating roller 11, the smaller the print count at which the toner spill began to occur.

It was under that condition that the radius of the developer stripping-coating roller was no less than that of the development roller, that is, when the requirement of "development roller radius≦developer stripping-coating roller radius" was satisfied, that images of high quality were outputted, that is, no image anomaly occurred, from the start of the durability tests, in which 10,000 copies were printed, to the end.

The inventors of the present invention carried out additional durability tests, in which the toner, the particles of which are aspherical and are 6 μm in weight average diameter; 10,000 copies were printed; and the development roller and developer stripping-coating roller were varied in radius, within the range of 4–10 mm. The results are given in the following table (Table 2).

In order to change the radius of curvature of the development roller 10, the radius of the development roller 10 was varied by adjusting the thickness of the elastic layer formed on the peripheral surface of the metallic core with a diameter of 6 mm (material for elastic layer was the same as described above; solid butadiene rubber was used). Further, the peripheral surface of the elastic layer of the development roller 10 was coated with a thin film (which in this embodiment was 30 μm thick urethane film as described before) to give toner an electric charge.

The radius of curvature of the peripheral surface of the developer stripping-coating roller 11 was varied by changing the thickness of the elastic layer formed of a foamed substance (which in this embodiment was urethane rubbers as was the material for the developer stripping-coating roller in accordance with the prior art) without changing the diameter (5 mm) of its metallic core.

Further, an arrangement was made so that the depth by which the developer stripping-coating roller 11 was compressed by the development roller 10 in the radius direction of the developer stripping-coating roller 11 became 1.0 mm, regardless of the combination, in terms of radius, between the development roller 10 and developer stripping-coating roller 11.

Further, another arrangement was made so that the peripheral velocities (which in this embodiment was 240 mm/sec) of the development roller 10 and developer stripping-coating roller 11 relative to each other, in the contact area, remained the same despite the changes in the radius of the developer stripping-coating roller 11.

In the following table, G means that there was no problem throughout the durability tests (preferable images were formed from the beginnings of the tests to the ends); F means that fog was generated during the durability tests (toner adhered to non-image points of the peripheral surface of the photosensitive drum); and N means that not only was "fog" generated, but also, "toner spill", that is, the phenomenon that toner particles not carrying a sufficient amount of electric charge spill from the development roller 10, occurred.

TABLE 2

| | | ROLLER RADII (mm) | | | | | | |
|---|---|---|---|---|---|---|---|---|
| | | 4 | 5 | 6 | 7 | 8 | 9 | 10 |
| DEV. ROLLER RADII (mm) | 4 | F | G | G | G | G | G | G |
| | 5 | F | G | G | G | G | G | G |
| | 6 | N | F | G | G | G | G | G |
| | 7 | N | N | F | G | G | G | G |
| | 8 | N | N | F | F | G | G | G |
| | 9 | N | N | N | F | G | G | G |
| | 10 | N | N | N | F | F | G | G |

G: No image defect
F: Fog is produced
N: Toner falls

It is evident from Table 2 that under the condition that the development roller was greater in radius than the developer stripping-coating roller, the smaller the radius of the developer stripping-coating roller, the more likely to occur the problems of fog formation and toner spill, whereas under that condition that the development roller was smaller in radius than the developer stripping-coating roller, the greater the radius of the developer stripping-coating roller, the less likely to occur the image defects.

Moreover, under the condition that development roller was greater in radius than the developer stripping-coating roller, the smaller the radius of the developer stripping-coating roller, the smaller the print count at which the fog formation and toner spill began to occur.

It was under the condition that the radius of the developer stripping-coating roller was no less than that of the development roller, that is, the requirement of "development roller radius<developer stripping-coating roller radius" was satisfied, that images of high quality were outputted, that is, no image anomaly occurred, from the start of the durability tests, in which 10,000 copies were printed and the development roller and developer stripping-coating roller were varied in radius within the range of 4–10 mm, to the end.

The reason for setting the minimum value for the rollers to 4 mm is as follows. That is, in consideration of the bending of the metallic cores of the rollers in the direction perpendicular to the lengthwise directions of the rollers, the radii of the rollers need to be no less than roughly 2.5 mm. Further, in order to assure that the developer stripping-coating roller can be compressed by the development roller by a minimum depth of 1 mm, the thickness of the elastic layer of the developer stripping-coating roller needs to be no less than 1.5 mm. This is why the minimum values for the development roller and developer stripping-coating roller were set to 4 mm.

The reason for setting the maximum values for the rollers to 10 mm is as follows. That is, in consideration of the market demand for smaller image forming apparatuses, it is necessary to reduce developing apparatus size. In addition, development rollers and developer stripping-coating rollers most in demand are no more than 10 mm in radius. Incidentally, even when the development roller and developer stripping-coating roller are no less than 10 mm in radius, the same effects as those described above can be obtained as long as the requirement or "development roller radius<developer stripping-coating roller radius" is satisfied.

The reason why the greater the developer stripping-coating roller radius, the smaller the amount by which toner spills from the development roller is as follows. That is, even if the developer stripping-coating roller 11 is increased in radius, the width of the contact area L between the development roller 10 and developer stripping-coating roller 11 barely changes, as described above, and also, the amount of the stress attributable to the metallic core of the developer stripping-coating roller 11 is reduced due to the increase in the thickness of the elastic layer, reducing thereby the maximum value Pmax of the stress in the contact area between the development roller 10 and developer stripping-coating roller 11, which in turn reduces the value of the integral $\int P$. As a result, the frictional force to which toner is subjected in the contact area is reduced, reducing the amount of toner deterioration.

The reason why the smaller the development roller radius, the smaller the amount by which toner spills from the development roller is as follows. That is, as the development roller 10 is reduced in radius, the width of the contact area L between the development roller 10 and developer stripping-coating roller 11 is reduced, reducing the total amount of the stress in the contact area ($\int P$), which in turn reduces the amount of the frictional force to which toner is subjected in the contact area. As a result, toner is less deteriorated.

The inventors of the present invention also carried out the following durability tests, in which 10,000 copies were printed per operation under various conditions. Incidentally, an arrangement was made so that the depth by which the developer stripping-coating roller 11 was compressed by the development roller 10 in the radius direction of the developer stripping-coating roller remained 1.0 mm regardless of the changes in radii of the development roller and developer stripping-coating roller.

(Ranges in which Various Factors were Varied)

Weight average toner particle diameter: 3–10 μm;

Hardness (Asker scale C) of development roller 10: 30–70°;

Hardness (Asker scale F) of developer stripping-coating roller 11: 30–90°; and Peripheral velocities of development roller 10 and developer stripping-coating roller 11 relative to each other: 50–600 mm/sec.

Also under the above described conditions, the above described tendencies were observed; under the condition that the development roller was greater in radius than the developer stripping-coating roller, the smaller the radius of the developer stripping-coating roller, the more likely to occur the problems of fog formation and toner spill, whereas under that condition that the development roller was smaller in radius than the developer stripping-coating roller, the greater the radius of the developer stripping-coating roller, the less likely to occur the image defects. Further, when the radius of the developer stripping-coating roller was greater than that of the development roller, the problems of fog formation and toner spill did not occur.

The following will be evident from the above description of this embodiment. That is, such problems as the occurrence of image defects, namely, fog, the toner spill, etc., that are attributable to the toner deterioration traceable to the frictional force to which toner is subjected in the contact area, that is, the nip between the development roller 10 and developer stripping-coating roller 11, can be prevented by satisfying the requirements that the development roller 10 is greater in hardness than the developer stripping-coating roller 11, and is smaller in radius of curvature than the developer stripping-coating roller 11, in the contact area.

Referring to Tables 1 and 2, there were cases in which the result of "no image defect" was obtained even through the development roller radius was equal to the developer stripping-coating roller radius. However, as described regarding the mechanism of this embodiment (FIGS. 9 and 10), it is evident that satisfying the requirement that the developer stripping-coating roller radius is greater than the development roller radius is more effective to reduce toner deterioration than satisfying the requirement that the developer stripping-coating roller radius is equal to the development roller radius. Therefore, it is preferable to satisfy the requirement that the developer stripping-coating roller radius is to be greater than development roller radius.

The aforementioned average particle diameter of the toner was obtained by the method employing a Coulter counter. More specifically, a Coulter counter TA-II or a Coulter multisizer (Coulter Co., Ltd.) was employed as a device for measuring the average toner particle diameter. The measuring method was as follows. Roughly 1% water solution of sodium chloride was prepared as electrolyte using first class sodium chloride: instead, Isoton-II (Coulter Co., Ltd.), for example, may be used. To 100–150 ml of the above described electrolyte, 0.1–5 ml of surfactant, preferably, alkylbenzene sulfonate is added as dispersant, and thereafter, 2–20 mg of test sample is added. The electrolyte in which the test sample was suspended was placed in an ultrasonic dispersing device, and was subjected to a dispersing process for roughly 1–3 minutes. Then, the weight average particle diameter of the toner was measured with the above described measuring apparatus fitted with a 100 μm aperture.

Embodiment 2

The second embodiment is related to a case in which spherical toner which is more likely to be deteriorated by the friction than aspherical toner is employed as developer. Since the developing apparatus and image forming apparatus in this embodiment are the same as those in the first embodiment, they will not be described in detail.

The toner in this embodiment is virtually spherical toner produced by polymerization. The particles of spherical toner are uniform in shape, being therefore uniform in development and transfer characteristics. Therefore, spherical toner is very suitable for the formation of a high quality image, and has been recently attracting a large amount of attention because of the increased demands for high quality in the market.

Spherical toner, however, has it own problem. That is, from the standpoint of deterioration, spherical toner is more likely to deteriorate than aspherical toner.

The reason for this problematic characteristic of spherical toner is as follows.

Figure 12:
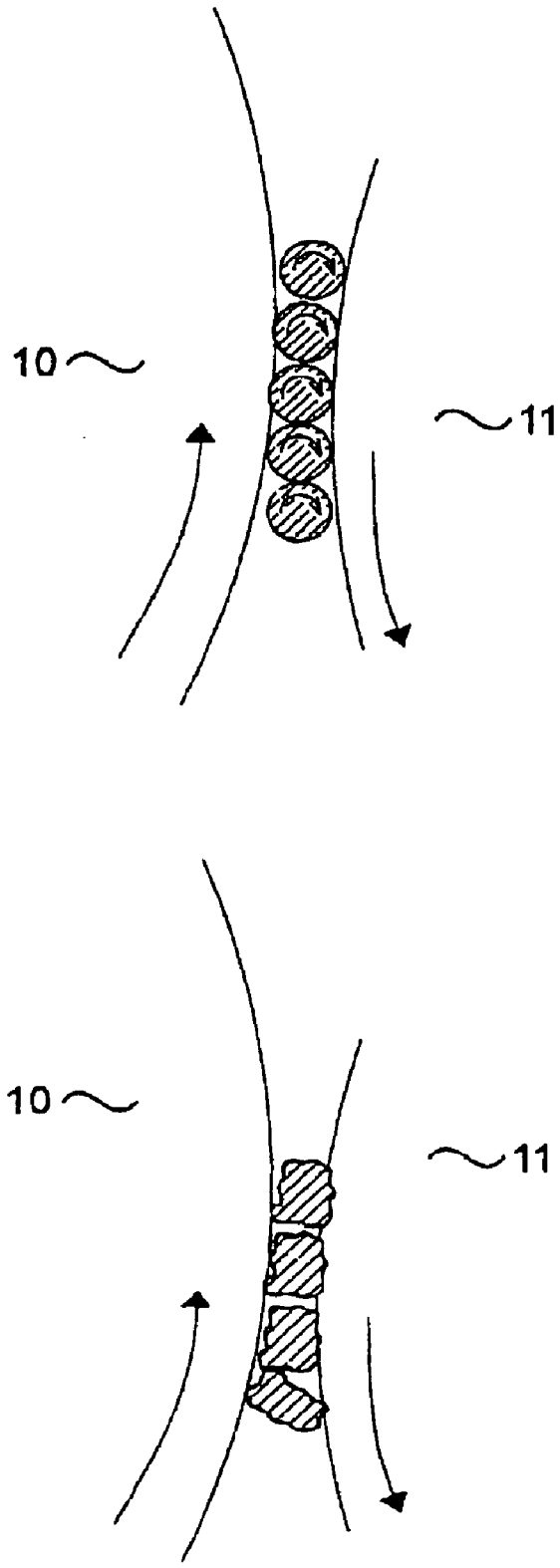
FIG. 12 is a schematic sectional view of toner particles in the second embodiment of the present invention.

FIG. 12 is a schematic sectional view of the contact area, and its adjacencies, between the development roller 10 and developer stripping-coating roller 11. The top side of FIG. 12 represents a case in which spherical toner is employed as developer, and the bottom side of FIG. 12 represents a case in which aspherical toner is employed as developer.

In the contact area between the development roller 10 and developer stripping-coating roller 11, the peripheral surfaces of the two rollers move in opposite directions. Therefore, the toner particles in the contact area are subjected to two forces different in direction (clockwise direction in FIG. 12). The spherical toner particles are easily rotated on their axes in the contact area, whereas the aspherical toner particles are less likely to be rotated on their axes, in the contact area, due to their irregular shapes.

Thus, a spherical toner particle is greater than an aspherical toner particle, in the cumulative size of the surface area by which a toner particle is subjected to the frictional force while being passed through the contact area. Therefore, a spherical toner particle is greater than an aspherical toner particle, in the amount by which external additive particles are embedded into the surface of a toner particle, being therefore more likely to suffer from the problems of the fog and the toner spill.

Incidentally, in this embodiment, spherical toner means toner, the shape factors SF-1 and SF-2 of which are within the ranges given below.

That is, SF-1 is in the range of 100–150, and SF-2 is in the range of 100–140.

The shape factor SF-1 is a parameter for the degree of sphericity, and the shape factor SF-2 is a parameter for the degree of surface roughness. The shape factor of a perfectly spherical toner particle is 100. The higher the degree of asphericity, the greater the value.

Figure 13:
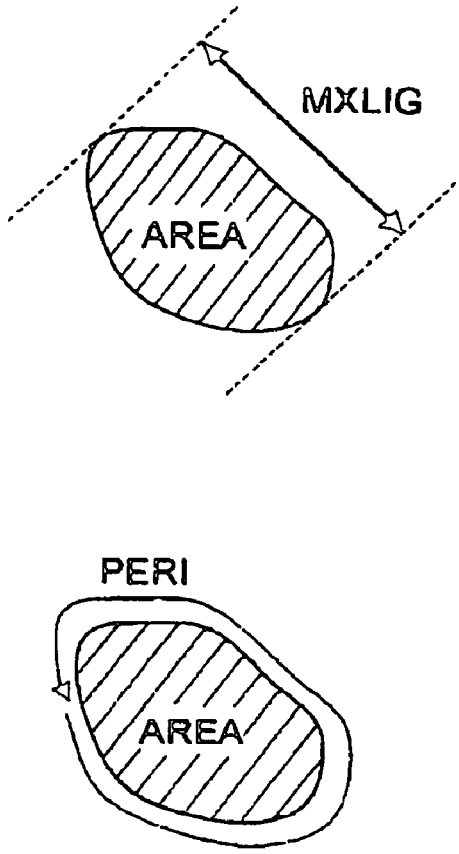
FIG. 13 is a schematic drawing for describing the shape factors of the toners in the second embodiment of the present invention.

The shape factors SF-1 and SF-2 of the toner particles are calculated using the following method. 100 randomly picked toner particles are photographed at 50× magnification, with the use of an FE-SEM (Hitachi, Ltd.). Then, the image data are fed into an image analyzing apparatus LUZEX3 (Nicore Co., Ltd.) and analyzed. Then, the two shape factors are calculated using the following mathematical formulas (FIG. 13).

$$SF\text{-}1=\{(MXLNG)^2/\mathrm{AREA}\}\times(\pi/4)\times 100$$

$$SF\text{-}2=\{(PERI)^2/\mathrm{AREA}\}\times(1/4\pi)\times 100$$

MXLNG: absolute maximum length

AREA: projected area of toner particle

PERI: circumference.

The inventors of the present invention carried out durability tests, in which a spherical toner (SF-1=120; SF-2=110), which was produced by polymerization and was 6 μm in weight average particle diameter, was used to produce 10,000 copies, and the development rollers and developer stripping-coating rollers were varied in radius as were in the tests carried out to examine the first embodiment. The results are given in the following table (Table 3).

The radius of curvature of the development roller was varied by adjusting the thickness of the elastic member (material for which is the same as the above described one; butadiene rubber) formed over the peripheral surface of the metallic core with a diameter of 6 μm. The development rollers were provided with a thin surface layer (30 μm thick urethane film, which is the same as the one in the first embodiment) coated over the peripheral surface of the elastic layer to give toner particles electric charge.

The developer stripping-coating rollers were made different in radius of curvature by changing the thickness of the elastic layer formed of a foamed substance (urethane rubber as is the foamed substance in accordance with the prior art), without changing the diameter of the metallic core.

Further, an arrangement was made so that in any combination of the development roller 10 and developer stripping-coating roller 11, the depth by which the developer stripping-coating roller 11 was compressed by the development roller 10 in the radius direction of the developer stripping-coating roller 11 became 1.0 mm.

Also, another arrangement was made so that the peripheral velocities of the development roller 10 and developer stripping-coating roller 11 relative to each other remained the same (which in this embodiment was 240 mm/sec).

In the following table, G means that there was no problem throughout the durability tests (preferable images were formed from the beginnings of the tests to the ends); F means that fog was generated during the durability tests (toner adhered to non-image points of the peripheral surface of the photosensitive drum); and N means that not only was "fog" generated, but also, "toner spill", that is, the phenomenon that toner particles not carrying a sufficient amount of electric charge spill from the development roller 10, occurred.

TABLE 3

| | | ROLLER RADII (mm) | | | | | | |
|---|---|---|---|---|---|---|---|---|
| | | 4 | 5 | 6 | 7 | 8 | 9 | 10 |
| DEV. ROLLER RADII (mm) | 4 | F | G | G | G | G | G | G |
| | 5 | N | G | G | G | G | G | G |
| | 6 | N | F | G | G | G | G | G |
| | 7 | N | N | F | G | G | G | G |
| | 8 | N | N | F | F | G | G | G |
| | 9 | N | N | N | F | F | G | G |
| | 10 | N | N | N | N | F | F | G |

G: No image defect
F: Fog is produced
N: Toner falls

It is evident from Table 3, under the condition that the development roller was greater in radius than the developer stripping-coating roller, the smaller the developer stripping-coating roller in radius, the greater the amount of the fog and the amount of the toner spill from the development roller, whereas under the condition that the development roller was smaller in radius than the developer stripping-coating roller, the greater the developer stripping-coating roller in radius, the less likely to occur the image defects.

Further, under the condition that the development roller is greater in radius than the developer stripping-coating roller, the smaller the developer stripping-coating roller in radius, the smaller the copy count at which the fog began to be generated and the toner began to spill from the development roller.

In terms of the copy count at which fog began to be generated and/or the toner began to spill from the development roller, the spherical toner employed in this embodiment was smaller than the aspherical toner used in the first embodiment, because the spherical toner is more easily deteriorated than the aspherical toner.

It was under the condition that the radius of the developer stripping-coating roller was no less than that of the development roller, that is, the requirement of "development roller radius<developer stripping-coating roller radius" was satisfied, that images of high quality were outputted, that is, no image anomaly occurred, from the start of the durability tests to the end, in which 10,000 copies were printed and the radii of the development roller and developer stripping-coating roller were within the range of 4–10 mm.

The inventors of the present invention also carried out the following durability tests, in which 10,000 copies were printed, and in which the specifications of the development roller 10 and developer stripping-coating roller 11 and the peripheral velocities of the development roller 10 and developer stripping-coating roller 11 were varied as shown below. Incidentally, an arrangement was made so that the depth by which the developer stripping-coating roller 11 was compressed by the development roller 10 in the radius direction of the developer stripping-coating roller remained 1.0 mm regardless of the changes in radii of the development roller and developer stripping-coating roller.

(Ranges of Variables)

Weight average toner particle diameter: 3–10 μm;

Hardness (Asker scale C) of development roller 10: 30–70°;

Hardness (Asker scale F) of developer stripping-coating roller 11: 30–90°; and Peripheral velocities of the development roller 10 and developer stripping-coating roller 11 relative to each other: 50–600 mm/sec.

Also under the above described conditions, the above described tendencies could be observed; under the condition that the development roller is greater in radius than the developer stripping-coating roller, the smaller the developer stripping-coating roller radius, the more likely the fog to occur, and the more likely the toner to spill from the development roller 10; under the condition that the development roller is smaller in radius than the developer stripping-coating roller, the greater the developer stripping-coating roller diameter, the less likely the image defect to occur; and under the condition that the developer stripping-coating roller is greater in radius than the development roller, the problems of fog formation and toner spill did not occur.

As described above, such problems as the occurrence of the image defect, namely, fogs, the toner spill, etc., that are attributable to toner deterioration traceable to the frictional force to which toner is subjected in the contact area, that is, the nip between the development roller 10 and developer stripping-coating roller 11, can be prevented by satisfying the requirement that the development roller 10 is greater in hardness than the developer stripping-coating roller 11, and is smaller in radius of curvature than the developer stripping-coating roller 11, in the contact area, in order to reduce the amount of the frictional force to which toner is subjected in the contact area between the development roller 10 and developer stripping-coating roller 11.

Referring to Table 3, there were cases in which the result of "no image defect" was obtained even through the development roller radius was equal to the developer stripping-coating roller radius. However, as described regarding the mechanism of this embodiment (FIGS. 9 and 10), it is evident that satisfying the requirement that the developer stripping-coating roller radius is greater than the development roller radius is more effective to reduce toner deterioration than satisfying the requirement that the developer stripping-coating roller radius is equal to the development roller radius. Therefore, it is preferable to satisfy the requirement that developer stripping-coating roller radius is to be greater than development roller radius.

Embodiment 3

Figure 14:
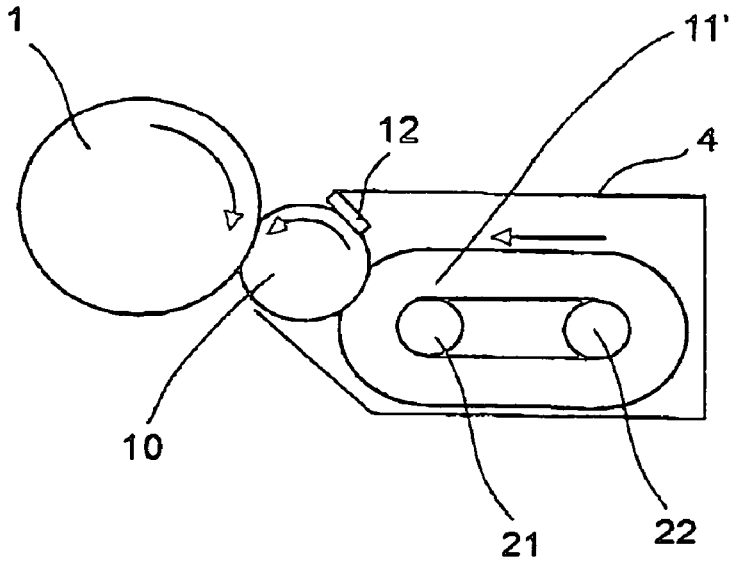
FIG. 14 is a schematic sectional view of the image forming apparatus in the third embodiment of the present invention.

In the first and second embodiment, both the developer bearing member and developer stripping-coating member were in the form of a cylindrical roller. In this embodiment, however, the developer stripping-coating roller is not uniform in radius of curvature; more specifically, it is an endless belt as shown in FIG. 14.

The apparatuses in this embodiment are the same as those in the first and second embodiments, except for the internal structure of the developing device 4. Therefore, the apparatuses themselves in this embodiment will not be described in detail.

The toner used in this embodiment is the same as that in the second embodiment, which is the spherical toner with a weight average particle diameter of 6 μm.

The development roller 10 in this embodiment is the same as that in the first embodiment; it is a cylindrical elastic member with a diameter of 14 mm comprising a metallic supporting shaft with a radius of 3 mm, an approximately 4 mm thick elastic layer formed of solid rubber, sponge, or the like (which in this embodiment is butadiene rubber), over peripheral surface of the metallic supporting member, and a surface layer (which in this embodiment is 30 μm thick urethane film) coated on the peripheral surface of the elastic layer to give toner particles electric charge.

The stripping-coating member 11' in this embodiment is an endless belt comprising: a 0.5 mm thick rubber belt as a substrate, and a 6 mm thick elastic layer formed of foamed substance (which is foamed urethane as is in the first and second embodiments) on the peripheral surface of the rubber belt. It is driven by the rotation of supporting shafts 21 and 22, which are metallic rollers with a radius of 2.5 mm.

In the developing device 4, the development roller 10 is disposed so that the depth by which the developer stripping-coating member 11' is compressed by the development roller 10 in center of the radius of curvature of the developer stripping-coating member 11' becomes 1 mm.

Referring to FIG. 14, the development roller 10 and developer stripping-coating member 11' are in contact with each other, in the area in which the developer stripping-coating member 11' is in contact with the peripheral surface of the supporting shaft 21. Therefore, when the developer stripping 10 coating member 11' is not in contact with the development roller 10, the radius of curvature of the portion of the developer stripping-coating roller 11', corresponding in position to the contact area, is 9 mm. The development roller 10 is in the form of a cylinder truly circular in cross section. Therefore, when the development roller 10 is not in contact with the developer stripping-coating roller 11', the radius of curvature of the portion of the peripheral surface of the development roller 10, corresponding in position to the contact area, is 7 mm, which is the same as the value of the radium of the development roller 10.

The peripheral velocity of the development roller 10 is 140 mm/sec, which is the same as that in the first embodiment. The peripheral velocity of the developer stripping-coating member 11' is 100 mm/sec, which is also the same as that in the first embodiment. Since the two members 10 and 11' are rotated so that their peripheral surfaces move in the opposite direction relative to each other, their peripheral velocities relative to each other are 240 mm/sec.

In the durability tests, similar to those carried out to examine the first and second embodiments, carried out under the above conditions, in which 10,000 copies were printed to test each combination of the development roller and developer stripping-coating member, problems such as fog formation, toner spill, etc., did not occur; high quality images could be outputted from start to finish.

The radii of curvature of the development roller and developer stripping-coating member were varied within the range of 4–10 mm.

The development rollers 10 were made different in radius by adjusting the thickness of the elastic member (the material for which was butadiene rubber, which was the same as that in the preceding embodiments) formed around the metallic core with a diameter of 6 μm. Further, the development rollers 10 were provided with a thin surface layer (which in this embodiment was 30 μm thick urethane film, which was the same as those in the preceding embodiments), which was coated on the peripheral surface of the elastic layer to give toner particles electric charge.

The developer stripping-coating members 11' were made different in radius of curvature by adjusting the thickness of the elastic layer formed or foamed substance, without varying the diameter of its supporting shaft 21. Further, an arrangement was made so that the depth by which the developer stripping-coating member 11' was compressed in the radius direction of the supporting shaft 21 by the development roller 10 remained 1.0 mm, regardless of the changes in the relationship between the radii of curvature of the development roller 10 and developer stripping-coating member 11'.

Further, another arrangement was made so that the peripheral velocities (which in this embodiment was 240 mm/sec) of the development roller 10 and developer stripping-coating member 11' relative to each other did not change despite the changes in the radius of curvature of the developer stripping-coating member 11'.

In order to examine the effects of the various combinations of the development roller and developer stripping-coating member 11' in terms of the radius of curvature upon toner deterioration, each combination was subjected to a durability test in which 10,000 copies were printed. It was the combinations in which the radius of curvature of the developer stripping-coating member 11' was greater than that of the development roller 10, in other words, the combinations that satisfied "development bearing member radius<stripping-coating member radius of curvature", that could output high quality images from the beginning of the test to the end.

Further, the durability tests were also carried out under the following conditions. Consequently, as long as the radius of curvature of developer stripping-coating member 11' was greater than the radius of the development roller 10, in other words, the requirement of "development roller radius<stripping-coating member radius of curvature" was satisfied, the problems of fog formation, toner spill, etc., did not occur.

(Ranges of Variables)

Weight average toner particle diameter: 3–10 μm;

Hardness (Asker scale C) of development roller 10; 30–70°;

Hardness (Asker scale F) of stripping-coating member 11: 30–90°; and

Peripheral velocities of the development roller 10 and developer stripping-coating roller 11 relative to each other: 50–600 mm/sec.

In this embodiment, the present invention was described with reference to the cylindrical development roller 10 and non-cylindrical developer stripping-coating member 11'. However, even in the case of developing apparatuses in which the developer bearing member(s) is not cylindrical, and the developer stripping-coating member(s) is cylindrical; or both the developer bearing member and developer stripping-coating member are non-cylindrical, the frictional force to which toner is subjected in the contact area between the developer bearing member and developer stripping-coating member can be reduced to prevent the problems such as fog formation, toner spill, etc., by making an arrangement so that when the developer bearing member and developer stripping-coating member are not in contact with each other, the radius of curvature of the portion of the peripheral surface of the developer stripping-coating member, corresponding in position to the contact area, is greater than that of the developer bearing member.

Further, the preceding embodiments of the present invention were described with reference to nonmagnetic single-component toner, the inherent polarity of which was negative. But, the application of the present invention is not limited to nonmagnetic single-component toner. For example, the employment of magnetic single-component toner, or toner which is inherently positive in polarity, will also bring forth the same effects as those described above.

Also in the preceding embodiments, silica was used as the external additive for the toner. However, the choice of external additive does not need to be limited to silica. The employment of ordinary external additive (alumina, titanium oxide, etc.) for controlling toner charge will also give the same effects as those described above.

Moreover, the preceding embodiments were described with reference to one of the reversal developing methods. However, the above described effects can be obtained no matter which developing method is employed, a reversal developing method or a normal developing method.

As described above, according to the present invention, of the developer bearing member and developer stripping-coating member employed by an image forming apparatus, the developer stripping-coating member which is softer than the developer bearing member is made greater in radius of curvature than the developer bearing member which is harder than the developer stripping-coating member, in order to reduce the amount of the frictional force generated in the contact area between the developer bearing member and developer stripping-coating member. As a result, excellent images, that is, images which do not suffer from fog, or defects attributable to the toner spill from the developer bearing member, can be formed.

While the invention has been described with reference to the structures disclosed herein, it is not confined to the details set forth, and this application is intended to cover such modifications or changes as may come within the purpose of the improvements or the scope of the following claims.

What is claimed is:

1. A developing apparatus comprising:

a developer carrying member for carrying a developer to develop an electrostatic latent image formed on an image bearing member, said developer carrying member having an elastic property;

a scraping/supplying member, contacted into said developer carrying member, for supplying the developer to said developer carrying member and for scraping the developer off said developer carrying member, said scraping/supplying member having an elastic property, wherein said developer carrying member has a hardness which is higher than that of said scraping/supplying member, and wherein said developer carrying member and said scraping/supplying member satisfy that in a state in which said scraping/supplying member is out of contact with said developer carrying member, a radius of curvature of said scraping/supplying member is larger than a radius of curvature of said developer carrying member at a position of contact between said scraping/supplying member and said developer carrying member; and wherein the radius of curvature of said developer carrying member is 4–10 mm at the position of the contact in the state in which said scraping/supplying member is out of contact with said developer carrying member.

2. A developing apparatus according to claim 1, wherein the radius of curvature of said scraping/supplying member is 4–10 mm at the position of the contact in the state in which said scraping/supplying member is out of contact with said developer carrying member.

3. An apparatus according to claim 1, wherein said developer carrying member has an Asker C hardness of 30–70 degrees.

4. An apparatus according to claim 3, wherein said scraping/supplying member has an Asker F hardness of 30–90 degrees.

5. An apparatus according to claim 1, wherein said scraping/supplying member has an Asker F hardness of 30–90 degrees.

6. An apparatus according to claim 1, wherein said scraping/supplying member is provided with a supporting shaft and an elastic foam member on a supporting shaft.

7. An apparatus according to claim 1, wherein a peripheral speed of said developer carrying member is lower than part of said scraping/supplying member.

8. An apparatus according to claim 1, wherein a relative peripheral speed between said developer carrying member and said scraping/supplying member is 50–600 mm/sec.

9. An apparatus according to claim 8, wherein a direction of peripheral movement of said scraping/supplying member is opposite a direction of peripheral movement of said developer carrying member at the position of the contact.

10. An apparatus according to claim 1, wherein the developer is non-magnetic one-component developer.

11. An apparatus according to claim 1, wherein the developer has a weight average particle size of 3–10 microns.

12. An apparatus according to claim 1, wherein the developer has a shape factor SF-1 of 100–150, and a shape factor SF-2 of 100–140.

13. An apparatus according to claim 1, wherein said developer carrying member is contactable to the image bearing member.

14. A developing apparatus comprising:

a developer carrying member for carrying a developer to develop an electrostatic latent image formed on an image bearing member, said developer carrying member having an elastic property;

a scraping/supplying member, contacted into said developer carrying member, for supplying the developer to said developer carrying member and for scraping the developer off said developer carrying member, said scraping/supplying member having an elastic property, wherein said developer carrying member has a hardness which is higher than that of said scraping/supplying member, and wherein said developer carrying member and said scraping/supplying member satisfy that in a state in which said scraping/supplying member is out of contact with said developer carrying member, a radius of curvature of said scraping/supplying member is larger than a radius of curvature of said developer carrying member at a position of contact between said scraping/supplying member and said developer carrying member, wherein said scraping/supplying member has an Asker F hardness of 30–90 degrees.

15. A developing apparatus according to claim 14, wherein the radius of curvature of said scraping/supplying member is 4–10 mm at the position of the contact in the state in which said scraping/supplying member is out of contact with said developer carrying member.

16. An apparatus according to claim 14, wherein said developer carrying member has an Asker F hardness of 30–70 degrees.

17. An apparatus according to claim 14, wherein said scraping/supplying member is provided with a supporting shaft and an elastic foam member on a supporting shaft.

18. An apparatus according to claim 14, wherein a relative peripheral speed between said developer carrying member and said scraping/supplying member is 50–600 mm/sec.

19. An apparatus according to claim 14, wherein a direction of peripheral movement of said scraping/supplying member is opposite a direction of peripheral movement of said developer carrying member at the position of the contact.

20. An apparatus according to claim 14, wherein the developer is non-magnetic one-component developer.

21. An apparatus according to claim 14, wherein the developer has a weight average particle size of 3–10 microns.

22. An apparatus according to claim 14, wherein the developer has a shape factor SF-1 of 100–150, and a shape factor SF-2 of 100–140.

23. An apparatus according to claim 14, wherein said developer carrying member is contactable to the image bearing member.

* * * * *

UNITED STATES PATENT AND TRADEMARK OFFICE

CERTIFICATE OF CORRECTION

PATENT NO. : 7,072,607 B2
APPLICATION NO. : 10/733358
DATED : July 4, 2006
INVENTOR(S) : Manami Haraguchi et al.

It is certified that error appears in the above-identified patent and that said Letters Patent is hereby corrected as shown below:

COLUMN 2:
Line 54, “above described” should read --above-described--.

COLUMN 3:
Line 21, “above described” should read --above-described--.

COLUMN 4:
Line 53, “will” should read --will be--.

COLUMN 5:
Line 27, “above” should read --above- --.

COLUMN 9:
Line 41, “an” should read --a--.
Line 50, “above’ should read --above- --.

COLUMN 10:
Line 37, “above described” should read --above-described--.

COLUMN 13:
Line 7, “printer;” should read --printed;--.
Line 8, “above described” should read --above-described--.

COLUMN 16:
Line 4, “which” should read --Which--; and “were” should read --Were--.
Line 13, “above described” should read --above-described--; and “above” should read --above- --.
Line 38, “through” should read --though--.
Line 58, “above” should read --above- --.
Line 66, “above described” should read --above-described--.

UNITED STATES PATENT AND TRADEMARK OFFICE

CERTIFICATE OF CORRECTION

PATENT NO. : 7,072,607 B2
APPLICATION NO. : 10/733358
DATED : July 4, 2006
INVENTOR(S) : Manami Haraguchi et al.

It is certified that error appears in the above-identified patent and that said Letters Patent is hereby corrected as shown below:

COLUMN 18:
Line 14, "above described" should read --above-described--.

COLUMN 19:
Line 46, "above described" should read --above-described--; and "above" should read --above- --.

COLUMN 22:
Line 48, "above described" should read --above-described--.

Signed and Sealed this

Sixteenth Day of January, 2007

JON W. DUDAS
*Director of the United States Patent and Trademark Office*